United States Patent [19]

Czajkowski et al.

[11] 4,188,283

[45] Feb. 12, 1980

[54] STARTUP METHOD FOR A MOVING-BED HYDROGENATION ZONE

[75] Inventors: George J. Czajkowski, Chicago; Frank Stolfa, Park Ridge, both of Ill.

[73] Assignee: UOP Inc., Des Plaines, Ill.

[21] Appl. No.: 913,710

[22] Filed: Jun. 8, 1978

Related U.S. Application Data

[60] Division of Ser. No. 761,504, Jan. 21, 1977, Pat. No. 4,119,530, which is a continuation-in-part of Ser. No. 610,479, Sep. 4, 1975, abandoned.

[51] Int. Cl.[2] ..... C10G 23/08

[52] U.S. Cl. ..... 208/143

[58] Field of Search ..... 208/143, 165, 152

[56] References Cited

U.S. PATENT DOCUMENTS

| | | | |
|---|---|---|---|
| 2,446,986 | 8/1948 | Simpson | 208/165 |
| 2,452,172 | 10/1948 | Willard | 208/165 |
| 2,903,420 | 9/1959 | Wilki | 208/165 |
| 3,826,737 | 7/1974 | Pegels et al. | 208/165 |

*Primary Examiner*—Herbert Levine

*Attorney, Agent, or Firm*—James R. Hoatson, Jr.; John F. Spears, Jr.; William H. Page, II

[57] ABSTRACT

A startup method for a moving-bed reactor used in a process for the hydrogenation of olefin-containing hydrocarbons. The reactor is brought on-stream at full capacity while it contains less than a full loading of catalyst, and quantities of catalyst are intermittently added to the reactor while the hydrocarbons are being processed. Catalyst removal is then begun at a rate lower than the rate of catalyst addition and adjusted when the catalyst retention volume of the reactor becomes filled.

2 Claims, No Drawings

STARTUP METHOD FOR A MOVING-BED HYDROGENATION ZONE

CROSS-REFERENCE TO RELATED APPLICATIONS

This application is a Division of our copending prior application Ser. No. 761,504 filed Jan. 21, 1977, now U.S. Pat. No. 4,119,530, Oct. 10, 1978, which prior application is a Continuation-In-Part of our now abandoned prior application Ser. No. 610,479 filed Sept. 4, 1975 abandoned. The teachings of these prior applications are incorporated herein.

FIELD OF THE INVENTION

The invention generally relates to the art of hydrocarbon processing including hydrogenation of olefinic materials, hydrodesulfurization and demetallization of heavy petroleum fractions and coal liquefaction. It more specifically relates to a method of starting and operating moving-bed reactor systems used for processing petroleum fractions such as naphthas, black oils or pyrolysis liquids. The invention is restricted to use with catalyst retention volumes containing a cylindrical bed of solid catalyst through which the reactants flow in a vertical direction.

PRIOR ART

Although not in widespread use commercially, moving-bed reactors have received much interest in the literature. This has been prompted, at least in part, by the rising use of moving bed reactors in reforming operations as described in U.S. Pat. Nos. 3,470,090; 3,692,496 and 3,838,039. For example, processes for black oil desulfurization using a moving-bed reactor are described in British Pat. No. 831,247 and U.S. Pat. Nos. 3,795,607; 3,873,441 and 3,900,390. U.S. Pat. No. 3,799,866 describes a process for the isomerization of $C_4$–$C_6$ normal paraffins in an annular moving-bed reactor, and U.S. Pat. No. 3,978,150 presents a normal paraffin dehydrogenation process in which a moving-bed reactor is used. The disproportionation of toluene in a moving-bed reactor to produce benzene and xylenes is described in U.S. Pat. No. 3,551,509.

In U.S. Pat. No. 3,826,737 (Cl. 203–143) the catalytic hydrotreatment of residual oils in a moving-bed reactor is described, with particular emphasis being placed on the method and apparatus used to transport the catalyst into and from the high pressure reaction zone. The preferred catalyst addition and withdrawal quantities are between 0.5 and 20% of the total catalyst inventory, but may be as small as 0.1% of the inventory. A similar but more basic process is described in an older reference, U.S. Pat. No. 3,730,880 (Cl. 208–213). In both of these references a compact bed of catalyst is moved downward through the reaction zones. These references do not suggest the use of unequal catalyst addition and withdrawal rates. They are solely directed toward overcoming traditional hydrocarbon processing problems by the use of a moving-bed reactor which is at all times full of catalyst.

U.S. Pat. No. 3,067,129 (Cl. 208–140) presents a fixed-bed reforming operation in which one or more of the series flow reactors is placed on-stream while it contains as little as 40% of the design (final) catalyst loading. This reference is limited to fixed-bed operation. However, it does specify that a portion of the ceramic balls acting as a support for the catalyst bed may be removed to provide more room for fresh catalyst. Apparently, this is accomplished through a manhole in the side of the reactor while the process is not in operation.

Another fixed-bed operation which is started with a less than complete catalyst charge is described in U.S. Pat. No. 3,694,351. Although primarily directed to the hydrodesulfurization of heavy oils, this reference states the disclosed operating method may be applied to other processes including the hydrogenation of the aromatic distillate produced as a by-product in thermocracking operations used for the manufacture of ethylene. It is specified that the reaction may initially contain only about 30% of the total amount of catalyst required for the entire run duration. Of particular importance to the subject discussion is the fact this reference states "no catalyst is removed from the system during a catalyst cycle so that there is a continuous or intermittent increase in catalyst in the reactor."

It is therefore believed that the prior art has not presented a startup method for moving-bed reactors wherein the reactor is brought on-stream in a partially empty state. It also does not contain a startup method in which the initial rate of catalyst removal is less than the rate of catalyst addition.

BRIEF SUMMARY OF THE INVENTION

The invention provides a startup method for a moving-bed reactor whereby the accumulation of substances having a deleterious effect on the operation or on the pressure drop through the reactor may be spread through a greater portion of the catalyst bed. The method of the invention comprises the steps of initiating on-stream operation while the reactor contains between 70–99 vol. % of the quantity of catalyst which the catalyst retention volume of the reactor is designed to contain, intermittently charging quantities of catalyst to the top of the reactor, and horizontally distributing this catalyst within the reactor. The method of the invention also comprises the steps of intermittently removing quantities of used catalyst from the bottom of the reactor at a lower rate than the catalyst is charged to the top of the reactor, and equalizing the rates of withdrawal and addition when the catalyst retention volume is filled with catalyst.

DETAILED DESCRIPTION

A large number of petroleum refining and petrochemical processes utilize a cylindrical bed of solid catalyst. The reactants flow through these beds in a vertical direction, typically downward, as compared to the horizontal or radial flow which occurs in a radial flow reactor. The present invention relates only to the operation of those reactors having a cylindrical bed of catalyst and not to reactors having an annular bed of catalyst. The invention is applied to moving-bed reactors. By the term "moving-bed reactor", it is intended to refer to reactors which contain a dense compact bed of catalyst wherein the catalyst particles rest upon one another in a manner resembling a fixed-bed reactor. The catalyst in these reactors is gradually replaced by removal at the bottom of the reactor and addition through the top of the reactor. Fluidized beds of catalyst or ebullient beds of catalyst are therefore not considered moving-bed reactors in the sense that that term is used herein.

Heretofore, moving-bed reactors have been started and operated with a full load of catalyst. That is, the catalyst retention volume of the reactor is filled with essentially 100 vol.% of the quantity of catalyst which the reactor is designed to contain. The catalyst retention volume is of course intended to include only those volumes within the reactor in which the catalyst normally resides and is in no way intended to refer to the total internal volume of the reactor, which includes various mechanical structures and void spaces such as reactant passageways. As used herein, the pertinent catalyst retention volumes will basically be cylinders between the points at which the reactants enter and leave the portion of the reactor designed to contain catalyst. The bottom of the catalyst retention volume may have a shape conforming to the bottom of the reactor. The catalyst retention volume of a reactor may be formed by two or more individual beds of catalyst separated by reactant redistributors, quench addition apparatus and other reactor internals. All of these beds make up the catalyst retention volume, and the description herein is not intended to include or refer to the situation when one of these beds of catalyst has a volume less than 70–99 vol.% of the catalyst retention volume.

In the operation of reactors there is often encountered some phenomenon which results in the eventual closure of the reactant passageways between catalyst particles in the catalyst bed. In many typical situations this will cause a pressure drop buildup which is concentrated at the point at which the reactants enter the reactor and first contact the catalyst. For instance, in the hydrodesulfurization of heavy oils such as black oils, vacuum gas oils or reduced crudes in a downflow reactor, the upper surface of the catalyst bed tends to become obstructed with a crust which forms in the top of the catalyst bed. The prior art has attempted to circumvent this situation by filtration of the feed stream, by the provision of an increased upper surface area through various basket-like flow distribution means and through the use of rupture discs or other flow-directing means to bypass this crust. Similar problems are to be expected in the processing of particulate-containing liquids derived from tar sands, oil shale or coal.

The prior art also includes the use of moving-bed reactors to solve the problem of catalyst bed plugging. However, the high temperature and pressure processes which are troubled with scale formation also present the greatest engineering problems when it is attempted to design the necessary catalyst transfer systems for a moving-bed reactor. This is especially true for the catalyst removal system. The present invention minimizes the catalyst withdrawal problems while still providing at least some of the benefits of a moving-bed reactor through the periodic renewal of the upper surface of the catalyst bed.

One of the major concerns in high pressure moving-bed processes is the dependable operation of the valves used in the catalyst removal system. In contrast to the valves used in the catalyst addition system, these valves will be in continuous contact with the solid catalyst. It is therefore likely that some catalyst particles will remain in the valve as it is being closed. The high pressure exerted on the valve seat in the localized positions of these particles may eventually damage the valve seat. It will therefore be incapable of delivering a positive seal as is desired. Adding to this problem is the fact that the trapped particles, although most likely crushed, will remain on the valve seat and thereby prevent the formation of an even seal. The valve will therefore probably leak to some extent. This undesirable result may be handled by the provision of another valve below the initial catalyst valve at the bottom of the catalyst bed. The upper valve is closed first. The lower second valve will therefore not be continuously covered with catalyst, and therefore the catalyst particles will hopefully fall free of the valve before it is closed. By this means a positive seal may be ensured. Nevertheless, this is a costly and complicated system.

In the widely used moving-bed reforming systems it is not necessary to close a valve on the catalyst removal system while catalyst is in contact with the valve. This is because the catalyst is suspended above the valve in a conduit by a high velocity gas stream. It has not been thought practical to utilize this catalyst withdrawal method on other than the low pressure reforming systems.

There is a second reason for concern in adapting high pressure hydrotreating processes to a moving-bed operation. This is the increased tendency of the catalyst to be less than free-flowing due to its present or past contact with liquid phase hydrocarbon charge stocks. The liquid may cause the catalyst to agglomerate. Furthermore, the polymeric and carbonaceous deposits which form on the catalyst, typified by the "encrustation" at the top of the catalyst bed, are likely to cause the catalyst particles to adhere to each other.

It is an objective of this invention to provide a startup method for moving-bed reactors. It is a further objective of this invention to provide a startup method for a moving-bed reactor processing a liquid phase feed stream in which the problems associated with the withdrawal of catalyst are minimized. This latter objective is achieved at least in part by the subject startup method which reduces the number of cycles of operation of the valves used in the catalyst withdrawal system.

A second cause of increased pressure drop through the reactor is the formation of polymeric materials on and within the catalyst. This occurs when various hydrocarbon streams such as pyrolysis liquids or coker oils which contain olefins and diolefins are heated. The polymers will form wherever the diolefins are heated. The problem is however especially acute in a reactor in which the diolefins are hydrogenated since this is an exothermic reaction. Not only do these polymeric materials form on the outside of the catalyst, but they also form within the pores of the catalyst and eventually swell to the extent that the catalyst begins to crack and disintegrate. This produces a powdering of the catalyst at the entrance to the reactor and greatly increases the pressure drop buildup. The invention provides a method of operating reactors which at least in part alleviates problems such as these by changing the catalyst which comprises the top of the catalyst bed and therefore in effect providing a new upper surface of the catalyst bed.

According to the method of the invention, the reactor is brought on-stream while it contains less than a full catalyst loading. As used herein, the term "on-stream operation" refers to the situation wherein essentially all of the designed throughput of the processing unit is entering the reactor while it is maintained at suitable processing conditions and the desired treatment is effected in the reactor. That is, the feed stream entering the reactor is equal to at least 90 vol.% of the design or rated capacity of the reactor. The amount of catalyst which is present in the reactor when it is initially brought on-stream is to be less than 99 vol.% of the catalyst which the catalyst retention volume of the reactor is designed to contain. It is preferred that the reactor contain a lesser amount within the range of from 70–95 vol.% of the designed catalyst loading. When the reactor is brought on-stream according to the method of the invention, it will therefore be operating at a liquid hourly space velocity higher than that which is normally employed within the reactor.

After placing the reactor on-stream, there is initiated the periodic addition of small quantities of catalyst to the top of the catalyst bed. This addition will preferably not begin until the reactor has operated for some length of time with the initial reduced catalyst loading. The time at which the catalyst addition will begin and also the rate of this addition will depend on several factors such as the rapidity with which the catalyst is deactivated or the pressure drop tends to increase. It is preferred that the catalyst addition does not begin until the reactor has been on-stream for a period of seven days.

The catalyst should be added at a rate which prevents the undesired pressure drop causing phenomenon from occurring to an unacceptable extent in the newly covered portions of the catalyst bed. For instance, in a heavy oil desulfurization process, the rate of catalyst addition should be sufficient to maintain a high degree of porosity through the top 10 inches of the catalyst bed by moving this zone upward at a rate which prevents the plugging which normally occurs. The important consideration is not the magnitude or frequency with which the quantities of catalyst are added to the reactor, but is the overall rate expressed in terms of pounds or volume units per time which must be controlled. As used herein the term "rate of catalyst transfer" is intended to refer to this overall time average rate. The catalyst is preferably added in relatively small quantities at frequent intervals such as once per hour or once every four hours. The quantities may be much larger and added at more infrequent intervals of from once a day to once a week. Each quantity of catalyst transferred during the initial period of operation when the reactor is not yet filled with catalyst should be in the range of from 0.1 to 5 vol.% of the quantity of catalyst which the reactor is designed to contain. It is preferred that each quantity added to the reactor is greater than 0.1 vol.% and less than 1 vol.% of the catalyst retention volume.

Means should be provided within the reactor to insure an even horizontal distribution of the catalyst over the upper surface of the catalyst bed. This may comprise simply dropping the catalyst into the reactor through a number of ports or using a cone-shaped distribution device. Preferably, a mechanical-type loader such as illustrated in U.S. Pat. No. 3,804,273 is adapted for use inside an operating reactor to allow the dense-loading of the catalyst. The catalyst is preferably passed into the reactor after having been prepared through the normal steps of drying, pressurization, reduction of sulfiding, etc., as the particular catalyst may require. The catalyst is physically added via a lock hopper-type device in a manner similar to that used on moving-bed reactors and well known to those skilled in the art.

Several additional benefits are obtained from the method of the present invention. One benefit is that the catalyst which is initially removed from the reactor will be more similar to that which is removed after the reactor has been on-stream for a considerable length of time. This allows the regeneration facilities to be started and lined-out sooner. This also presents a time during which the regeneration system may be tested. If a problem is subsequently found with the catalyst removal or regeneration systems, on-stream operation may be maintained by adding fresh catalyst to maintain the overall desired catalyst activity without the necessity of removing any catalyst. This allows time to obtain replacement parts or to make needed repairs. Furthermore, during a turnaround situation, it allows a more uniform application of the labor force, since the work on the regeneration system need not be completed before the reaction system is brought on-stream.

In accordance with the above description, the invention may be broadly characterized as comprising a method of operating a moving-bed reactor containing a bed of solid catalyst in a substantially cylindrical catalyst retention volume which comprises the steps of starting on-stream operation of the reactor at conversion conditions with the catalyst retention volume of the reactor being less than 95 vol.% full; intermittently charging a quantity of catalyst to the reactor and horizontally distributing the catalyst on top of the bed of solid catalyst; and intermittently removing a quantity of used catalyst from the bottom of the reactor.

Those knowledgeable in the art will recognize that the method of the invention may be applied to a moving-bed reactor in several different ways. For instance, the reactor may be brought on-stream with the reduced loading of catalyst and subsequently filled by the periodic addition of catalyst before any catalyst is removed from the reactor. However, it is preferred that the catalyst removal from the bottom of the reactor is initiated at some time prior to the time at which the reactor is filled. It is further preferred that the rate of catalyst removal is maintained at an initial rate less than the rate of catalyst addition until the time at which the reactor is filled with the catalyst. The rate of catalyst addition and the rate of catalyst removal are then equalized when the catalyst loading is equal to the designed catalyst capacity of the reactor. It is specifically preferred that catalyst removal does not begin until at least five days after catalyst addition is initiated.

As previously mentioned, the present invention is particularly adaptable to use with the processes of hydrodesulfurization and demetallization of petroleum fractions, the hydrogenation of olefinic materials and the hydrogenation of liquids derived from coal. These processes are not novel, and there exists a large body of prior art as to their operation. Nevertheless, a more detailed description of these processes will be provided to aid in the understanding of what these processes are intended to include and how the invention is adapted to them.

U.S. Pat. Nos. 3,161,586; 3,215,618; 3,537,981 and 3,537,982 describe processes for the hydrogenation of feed streams containing polymer-forming deleterious olefinic materials. As used herein, the term "olefinic materials" is intended to refer to unsaturated hydrocarbons and other chemical compounds having carbon-carbon double bonds including olefins, conjugated diolefins such as butadienes and styrene, and indenes. These materials are often found for instance in pyrolysis liquids, distillates from fluid cokers, coke oven light oils and coal gasification side product liquids. The deleterious materials are not found in large amounts in raw petroleum fractions and result from prior processing, especially high temperature non-catalytic processing.

Since the undesirable polymers tend to form whenever these liquids are heated, their hydrogenation is conducted at relatively low temperatures. Satisfactory conversion conditions for a hydrogenation reactor loaded with the preferred palladium-containing catalyst include a temperature in the board range of from 250° F. to 500° F. Preferably, the reactor is operated at from 270° F. to about 400° F. On-stream hydrogenation conditions also include a pressure in the board range of from about 100 psig. to about 1200 psig, and preferably in the range of from 500 to 800 psig. There is maintained a liquid hourly space velocity in the range of from about 1 to 8 based on the combined charge and a molar excess of hydrogen, typically in the range of from 500 to about 2000 standard cubic feet of hydrogen per barrel of combined charge. Other operating techniques, such as the recycle of various treated streams and the use of diluents to reduce the Diene Value of the feed stream are known to those skilled in the art and are described in detail in the references cited above.

The preferred hydrogenation catalyst comprises spheres of lithiated alumina containing from 0.05 wt.% to about 5.0 wt.% palladium. The spheres are prepared by the oil drop method in accordance with the teachings of U.S. Pat. No. 2,620,314 and impregnated with palladium through the use of dinitrodianisole palladium. After drying to visual dryness and additional drying in air at 100° F. for about 1 hour, the palladium-containing spheres are calcined at about 1100° F. for about 2 hours. Lithium is then incorporated on the spheres using lithium nitrate in an impregnation operation, and the spheres are again dried and calcined to produce a lithium content of between 0.33 wt.% and 2.0 wt.%. The preferred catalyst consists of 1/16-inch alumina spheres containing 0.4 wt.% palladium and 0.5 wt.% lithium.

The preferred embodiment of the invention may be characterized as a startup method for a hydrogenation process in which a feed stream comprising hydrogen and olefinic materials is contacted with a bed of solid hydrogenation catalyst located in a substantially cylindrical catalyst retention volume which comprises the steps of passing the feed stream downward through the moving-bed reactor while less than 99 vol.% of the catalyst retention volume of the moving-bed reactor is filled by the bed of solid catalyst and effecting the hydrogenation of olefinic materials in the feed stream at on-stream hydrogenation conditions including a pressure of from about 100 psig. to about 1200 psig. and a temperature of from about 250° F. to about 500° F.; intermittently charging a quantity of catalyst greater than 0.1 vol.% of the catalyst retention volume and less than 5.0 vol.% of the catalyst retention volume per intermittent charge of catalyst to the reactor at a first rate of catalyst transfer and horizontally distributing each quantity of catalyst on top of the bed of solid catalyst; intermittently removing a quantity of used catalyst from the bottom of the reactor at a second rate of catalyst transfer less than the first rate of catalyst transfer; and, equalizing the first and the second rates of catalyst transfer when the catalyst retention volume of the moving-bed reactor becomes filled.

The inventive concept may be applied to any reactor used in the broad field of hydroprocessing which meets the criteria previously set out. As used herein, the general term "hydroprocessing" is intended to include and refer to those operations described in FIGS. 1 and 2 on page 174 of the Oct. 7, 1968 issue of the *Oil and Gas Journal.* This broad field is divided into three main subdivisions. The first is hydrotreating, wherein small amounts of materials including sulfur and nitrogen contained in various organic molecular structures are removed from the charge stock with very little molecular cracking. The second subdivision is hydrocracking, wherein at least 50% of the charge stock is cracked into components having a lower molecular weight, such as the production of a naphtha from a heavy distillate. Hydrorefining is between these two extremes and results in molecular changes to up to 10% of the feed together with impurity removal.

The method of manufacture or composition of the catalysts used during the hydroprocessing operation is not critical. The catalyst may therefore be any suitable commercially available catalyst or one of a proprietary nature. These catalysts are normally formed as a sphere by an oil drop method such as that demonstrated in U.S. Pat. No. 2,774,743 or extruded or pelleted. It is generally preferred that a spherical catalyst is used in reactor systems involving catalyst movement. Basic to the manufacture of nearly all hydroprocessing catalysts is the incorporation of a metal of Group VIII of the Periodic Table on a refractory inorganic oxide carrier by coprecipitation or impregnation. The more commonly used metals from this group are iron, cobalt, nickel, platinum and palladium. In addition, metals from Group VI-A such as chromium, molybdenum or tungsten are also often compounded into the catalyst. The composition of the catalyst chosen will be based on a consideration of both the feedstock and desired products. The carrier material may be natural or synthetic and will normally be selected from alumina, silica, zirconia, boria or combinations of any of these materials, particularly alumina in combination with one or more of the other oxides. An especially preferred catalyst composition is from 1 to 20 wt.% cobalt and from 0.1 to 10 wt.% molybdenum supported on alumina spheres. A more detailed listing of suitable catalyst compositions and manufacturing techniques may be obtained by reference to U.S. Pat. Nos. 3,203,889; 3,254,018; 3,525,684 and 3,471,399.

The conversion conditions necessary for any hydroprocessing operation are determined by the charge stock, the catalyst used and the desired result of the process. A broad range of hydroprocessing conditions includes a temperature of from 500° F. to 1,000° F., a pressure of from 300 psig. to 4000 psig, and a liquid hourly space velocity of 0.1 to about 3.0. The liquid hourly space velocity is defined as the hourly volume at 60° F. of the hydrocarbon charged to the reactor divided by the volume of the catalyst in the reactor. The exact reactor temperature required is determined by the initial activity and prior use of catalyst. More specific examples of reaction conditions are contained in the above-listed United States Patents. As a general rule, the preferred operating pressure will increase with the boiling point of the material being processed.

In all hydroprocessing operations hydrogen is circulated through the process at a rate of about 1000 to about 5,000 scf./Bbl. of charge material. This is to increase the partial pressure of hydrogen, thereby resulting in better catalyst stability, and to provide the hydrogen needed for the formation of ammonia and hydrogen sulfide from the nitrogen and sulfur removed from the charge stock and also for the saturation of olefinic hydrocarbons formed by the cracking of large complex molecules. Hydrogen consumed in this manner must be replaced at a rate equal to its consumption, which will vary from about 10 scf./Bbl. to about 100 scf./Bbl. during hydrotreating and up to about 3,000 scf./Bbl during hydrocracking.

The methods of the present invention may also be applied to the manufacture of various petroleum products from oil shale, tar sands or coal as a means of limiting the plugging of the upper surface of the first bed of solid catalyst through which the initially produced fluids pass. This will in turn lessen the problem of removing fine inert particles, such as rock and ash, from these fluids prior to this catalytic treatment. However, the present invention is best suited for use in a process wherein the initial fluids are obtained in a liquid state and may contain particulate solids. It is therefore more suitable for utilization in a process for the solvent liquefaction of coal as compared to a process using an initial retorting step, such as the predominant oil shale and tar sands extraction methods.

Coal liquefaction technology has been present for a considerable time, but the process has never reached commercial acceptance for economic reasons. The present energy situation has possibly changed this and has prompted intense developmental efforts in this area which have led to the evolution of several different processes. These are reviewed in the *Oil and Gas Journal* for Aug. 26, 1974 and the July 22, 1974 edition of *Chemical Engineering*. Specific examples of coal liquefaction processes are found in U.S. Pat. Nos. 3,505,203; 3,520,794; 3,583,900 and 3,598,717. One of the main problems in the commercialization of these processes is the separation of the liquid-coal from undissolved coal, ash and other fine particulate matter. This has been recognized in U.S. Pat. Nos. 3,503,863; 3,598,718 and 3,645,885.

The large number of coal liquefaction processes renders it impossible to describe all situations in which the invention may be utilized. However, the general process will preferably include the initial pulverization of a bituminous coal having a high volatile content to an average particle diameter equivalent to at least a -14 Tyler Screen Size in the presence of a solvent. This solvent is preferably but not necessarily of the hydrogen donor type and is at least partially hydrogenated, such as naphthenic-aromatic hydrocarbons. Typically, the solvent is a mixture of hydrocarbons and has a boiling point between about 200° C. and 425° C. Examples of suitable solvents are the di- or tetrahydroderivatives of anthracene and phenanthrene or the aromatic hydroderivatives of naphthalene. The solvent stream is often formed by the hydrogenation of a suitable fractionation zone product stream derived from the coal itself.

The coal particles are then contacted with the solvent in a liquefaction zone operated at an elevated temperature of from about 150° F. to about 1000° F. and at a pressure within the broad range of about 50 psig. to about 3500 psig. Preferably, the pressure is sufficient to maintain the solvent in a liquid state and is about 100 psig. Liquefaction conditions also include the solvent being present in a weight ratio of from 1 to about 5 parts solvent per part coal and the presence of gaseous hydrogen. The liquefaction zone may be agitated or of the upflow design which is utilized to separate ash-forming solids.

The action of the solvent, heat and hydrogen result in the dissolution or liquefaction of the coal particles and the formation of a liquefaction zone effluent stream containing both the solvent and coal derived liquids. This material is normally subjected to a vapor-liquid separation to recover hydrogen and then passed into a fractionation and solvent recovery zone. This results in the formation of several hydrocarbon streams having different boiling point ranges. Normally, most of the initially added solvent is recovered in one of these streams, and this stream is then further purified or subjected to a hydrogenation step and further separated to recover the solvent. One or more liquefaction zone product streams containing coal derived liquids having higher boiling points than the solvent-containing stream are also formed in the typical fractionation zone. These streams will normally be hydroprocessed as through catalytic hydrogenation, hydrodesulfurization and hydrocracking, etc. It is in the first of these downstream hydroprocessing operations that the present invention will be most useful in counteracting the plugging of catalyst beds by the ash remaining in the heavier coal derived liquids. The invention may also be used in the hydrotreating of the solvent-containing stream. In either case, it is performed in the manner previously described.

This embodiment of the invention may be characterized as a process for the manufacture of liquid hydrocarbonaceous products from coal which comprises passing a mixture of coal particles and a liquid solvent into a coal liquefaction zone maintained at a pressure of from about 50 psig. to about 3500 psig. and a temperature of about 150° F. to about 1000° F. and effecting the formation of a liquefaction zone effluent stream comprising liquid materials formed by the action of the liquid solvent upon the coal particles, passing the liquefaction zone effluent stream into a solvent recovery zone and effecting the removal of a portion of the liquid solvent from the liquefaction zone effluent stream and the formation of a liquefaction zone product stream, passing a feed stream comprising hydrogen and the liquefaction zone product stream downward through a reactor containing a bed of solid catalyst located in a cylindrical catalyst retention volume while less than 99 vol.% of the catalyst retention volume of the reactor is filled with catalyst and effecting the hydroprocessing of the liquefaction zone product stream at on-stream conversion conditions, intermittently charging a quantity of catalyst to the reactor and horizontally distributing the quantity of catalyst on top of the bed of catalyst, and intermittently removing a quantity of catalyst from the bottom of the reactor. As in the other embodiments of the invention, the rate of catalyst removal may be varied during the course of the startup of the process.

We claim as our invention:

1. A startup method for a hydrogenation process in which a feed stream comprising hydrogen and olefinic materials is contacted with a bed of solid catalyst located in a substantially cylindrical catalyst retention volume which comprises the steps of:

(a) passing the feed stream downward through a moving-bed reactor while less than 99 vol.% of the catalyst retention volume of the moving-bed reactor is filled by the bed of solid catalyst and effecting the hydrogenation of olefinic materials in the feed stream at on-stream non-cracking hydrogenation conditions including a pressure of from about 100 psig. to about 1200 psig. and a temperature of from about 250° F. to about 500° F. and a hydrogen feed rate of about 500 scf/bbl to 2000 scf/bbl;

(b) intermittently charging a quantity of catalyst greater than 0.1 vol.% of the catalyst retention volume and less than 5.0 vol.% of the catalyst retention volume per intermittent charge of catalyst to the reactor at a first rate of catalyst transfer and distributing each quantity of catalyst on top of the bed of solid catalyst;

(c) intermittently removing a quantity of used catalyst from the bottom of the reactor at a second rate of catalyst transfer less than the first rate of catalyst transfer; and, (d) equalizing the first and the second rates of catalyst transfer when the catalyst retention volume of the moving-bed reactor becomes filled.

2. The method of claim 1 further characterized in that on-stream operation of the reactor is initiated when the catalyst retention volume is less than 95 vol.% full.

* * * * *